US009273502B2

(12) United States Patent
Bell

(10) Patent No.: US 9,273,502 B2
(45) Date of Patent: Mar. 1, 2016

(54) PINLESS ATTACHMENT SYSTEMS AND METHODS OF USING THE SAME

(71) Applicant: John Richard Bell, Laughlin, NV (US)

(72) Inventor: John Richard Bell, Laughlin, NV (US)

( * ) Notice: Subject to any disclaimer, the term of this patent is extended or adjusted under 35 U.S.C. 154(b) by 0 days.

(21) Appl. No.: 14/249,296

(22) Filed: Apr. 9, 2014

(65) Prior Publication Data

US 2015/0000081 A1 Jan. 1, 2015

Related U.S. Application Data

(60) Provisional application No. 61/841,095, filed on Jun. 28, 2013.

(51) Int. Cl.
*E05D 1/04* (2006.01)
*E05D 7/10* (2006.01)

(52) U.S. Cl.
CPC ..... *E05D 1/04* (2013.01); *E05D 7/1066* (2013.01); *E05Y 2900/148* (2013.01); *E05Y 2900/602* (2013.01); *Y10T 16/52* (2015.01); *Y10T 16/535* (2015.01); *Y10T 29/24* (2015.01)

(58) Field of Classification Search
CPC ..... Y10T 16/52; Y10T 16/525; Y10T 16/535; Y10T 16/536; Y10T 16/542; Y10T 29/24; E05D 1/00; E05D 1/04; E05D 1/06; E05D 7/1066; E05Y 2900/148; E05Y 2900/602; E04F 10/00
USPC ..... 16/221, 225, 254, 260, 355; 29/10; 49/397
See application file for complete search history.

(56) References Cited

U.S. PATENT DOCUMENTS

| | | | | |
|---|---|---|---|---|
| 634,369 | A | 10/1899 | Quimby | |
| 678,701 | A | 7/1901 | Tuor | |
| 1,665,432 | A * | 4/1928 | Barclay | 49/208 |
| 2,644,192 | A | 7/1953 | McClellan | |
| 2,834,072 | A | 5/1958 | Miller | |
| 3,263,369 | A | 8/1966 | Siegal et al. | |
| 3,718,943 | A * | 3/1973 | Bustin | 16/355 |
| 5,329,667 | A | 7/1994 | Erskine | |
| 5,809,617 | A | 9/1998 | Harris et al. | |
| 5,964,466 | A | 10/1999 | Hintenlang et al. | |
| 6,829,861 | B1 * | 12/2004 | Kobrehel et al. | 49/356 |
| 6,941,616 | B2 | 9/2005 | Roy | |

* cited by examiner

*Primary Examiner* — William Miller
(74) *Attorney, Agent, or Firm* — Brian K Dinicola; Dinicola & Young PC

(57) ABSTRACT

A multi-purpose pinless attachment system includes a first structure having oppositely facing recesses separated by a web region. Pairs of recesses form pivot bar bearing surfaces, and a transverse pivot axis passes through the web region at a midpoint between these pairs of bearing surfaces. A second structure defines an interior pivot channel between its distal tip and a proximal shank. The tip is separated from the shank by a gap to allow the web region of the first structure to pass through the gap while the interior pivot channel is brought into bearing registration with the pivot bar. The pivot channel receives the portion of the web region separating the first and second recesses. Surface portions of the pivot channel frictionally engage at least a portion of a pivot bar bearing surface while the second structure is pivoted relative to the first structure about the transverse pivot axis.

20 Claims, 8 Drawing Sheets

PINLESS ATTACHMENT SYSTEMS AND METHODS OF USING THE SAME

REFERENCE TO RELATED APPLICATIONS

This application claims the benefit of priority to U.S. Provisional Patent Application Ser. No. 61/841,095 entitled ATTACHMENT DEVICE and filed on Jun. 28, 2013.

BACKGROUND OF THE INVENTION

1. Field of the Invention

This invention relates generally to systems and methods for enabling one structure to be attached and/or pivotably moved relative to another structure and, more particularly, to attachment assemblies of the pinless hinge type configured to both pivotably and releasably couple such structures.

2. Discussion of the Background Art

In its most familiar form, a hinge includes a pair of hinge halves with each hinge half including a wing section and a half channel coupled to the wing section. When the half channels of the hinge halves are aligned, the half channels form a pivot channel for receiving a separate pivoting pin. When the wing sections are attached to respective objects or structures, such as a door and a door frame, an awning and wall structure, a lid and container, or even a picture frame strut to a picture frame, the structures are able to move pivotably with respect to each other about the pivoting pin. There are a number of disadvantages associated with the "standard" pin-type or three-piece hinge. These include the relatively high cost of forming accurately aligned and well-fitted openings for receiving the pin, susceptibility to malfunction from dirt or corrosion, and the fact that the pin itself may be broken, displaced or lost altogether.

A further disadvantage of the pin-type hinge is most readily appreciated in certain contexts, such as when one (or each) of the wing sections is attached to a large, heavy, and/or unwieldy structure. When a conventional hinge is used for such situations, it is difficult to align the two hinge halves long enough to insert the pin. An individual working alone with pin-type hinges may find the task of pivotably coupling such cumbersome structures to be very difficult or even impossible. The process of detaching one structure from another can be equally laborious to an individual working alone.

A number of alternatives to the conventional three-piece (pin-type) hinge have been developed over the years. To simplify the coupling and decoupling of two pivotably attached structures, for example, a variety of so-called "pinless" hinge arrangements have been proposed. While these arrangements vary widely in their configuration and intended applications, they can nonetheless be classified into at least three general categories.

One of the earliest categories of pinless hinge arrangements is the "integral pivot pin" type exemplified by U.S. Pat. No. 678,701 issued to J. B. Tuor on Jul. 16, 1901 and entitled "Separable Hinge". The two-piece hinge assembly described by Tuor is configured for operation in a substantially vertical plane, and has particular applicability to the hanging of storm sashes and other structures over a framed window opening. An upper wing section has an upper flange section securable to the window frame proximate a lower edge thereof. Downwardly depending from the upper flange section are two channel-forming hooks open at their upper end and laterally separated from one another. The cavities formed by the two hooks define a transverse pivot channel. A lower wing section of the hinge has a lower flange section for attachment to a storm sash or other structure, an integral shank extending upwardly from the lower flange section, and a transverse pivot bar integrally formed at the end of the shank. The integral pivot bar of the second wing section functions as a pivot pin, and the width of the gap formed between the two hooks of the first wing section is such that the shank can move freely within it while leaving the pivot bar supported at both ends by one of its hooks. Removal requires lifting the sash to bring the pivot bar out of registration with the hooks.

One of the principal deficiencies of the Tuor arrangement is that its lower wing section, with its integral shank and transverse pivot bar structure, is complex and expensive to manufacture. Another is that it is difficult to adapt this arrangement to the pivotable coupling of one or more cumbersome objects such, for example, as long shelves or awnings, where alignments of the respective wing sections must be achieved across much wider distances. More substantial deficiencies reside in the fact that the hinge assembly is not self-locking (e.g., the lower wing section of Tuor may easily work loose or become dislodged out of registration with the open channel defined by the upper wing section). Finally, the respective wing sections are strictly adapted for attachment to coplanar vertical surfaces.

Another category of pinless hinge arrangements is the "stationary pivot pin" type exemplified by U.S. Pat. No. 2,644,192 issued to R. E. McClellan on Jul. 7, 1953 and entitled "Detachable Hinge". The two piece hinge assembly described by McClellan is more or less an adaptation of the Tuor arrangement wherein a first wing section defining the pivot bar is stationary and oriented in a horizontal, rather than a vertical plane, while the pivot channel defined by the second wing section extends from an offset shank attached to the flange. As in Tuor, the pivot axis defined by the pivot bar is oriented in a horizontal axis. A planar structure such as a drop leaf for a desk or table has two of the second wing sections attached two its lower face proximate a lateral peripheral edge. A space, between the desk or table and the fixed pivot axis defined by the pivot bar of respective first wing sections, enables the pivot channel and offset shank of the second wing section to pass through and under the desk surface while the leaf is held inserted at an angle. The leaf is then lowered into a horizontal position and pushed forward so that the surfaces of each pivot bar and each offset shank prevent rotation of the leaf. A locking detent and aperture system prevents lateral translation of the leaf while it is in use. When not needed, the McClellan structure is pivoted slightly to release the locking detent from the aperture, and then the leaf is pulled far enough to bring the respective pivot channels into registration with corresponding pivot bars and fully into the gap. In this position, the leaf can be rotated about the horizontal pivot axis into a vertical position suitable for storage.

The McClellan pinless hinge arrangement suffers from deficiencies similar to the ones noted in connection with Tuor. For example, the McClellan structure is limited to situations in which one of the two pivotably connected structures remains disposed in a horizontal plane. Like Tuor, the McClellan device is not self-aligning but instead requires all mating hinge components to be precisely aligned for proper operation. Also like Tuor, the McClellan device does not permit relative adjustment of the hinge components or associated structures once the hinge components are attached. Neither are the Tuor or McClellan structures well adapted for use by a single installer where large structures are to be pivotably coupled. This is because the spacing between hinge sections secured to one structure is often so great that these sections cannot be aligned with complementary sections on the other structure without help. Finally, the absence of an intrinsically stable locking system means that the drop leaf hinge assembly taught by McClellan cannot be safely adapted to heavier duty applications such, for example, as those where a heavily loaded ancillary structure might pull away from the primary working surface to which it is pivotably secured. If such a structure were to drop down unexpectedly, it could seriously injure workers in the area and/or damage adjacent structures and equipment.

Yet another type of pinless hinge, which may be thought of as the "telescoping" or "extruded" type hinge, includes a first wing section. At one end of the first wing section, a flange is formed, the flange being attachable to a first structure. At the other end of the first wing section is a transverse slotted tube defining both an internal pivot channel and an axial slot. A second wing section has at one end a flange attachable to a second structure and, at the other end, a tubular transverse pivot bar dimensioned and arranged so that it can be inserted laterally in telescoping fashion into the pivot channel while a web region connecting the flange and pivot bar is aligned with the axial slot. The edges of the axial slot act as "stops", wherein the width of the slot determines the degree to which the second wing section can be rotated about the pivot axis defined by the pivot channel of the first wing section. Representative examples of the telescoping or extruded type of pinless hinge are disclosed in U.S. Pat. No. 2,834,072 issued to Miller on May 13, 1958 and entitled "Awning Structure; in U.S. Pat. No. 3,263,369 issued to Siegal et al. on Aug. 2, 1996 and entitled "Awning Structure"; in U.S. Pat. No. 5,329,667 issued to Erskine on Jul. 19, 1994 and entitled "Pinless Hinge"; in U.S. Pat. No. 5,809,617 issued to Harris et al. on Sep. 22, 1998 and entitled "Mounting for Movable Members"; and in U.S. Pat. No. 6,941,616 issued to Roy on Sep. 13, 2005 and entitled "Pinless Hinge".

While the extruded or telescoping variety of pinless hinge is less susceptible to unexpected separation than the other categories of hinges described above, certain deficiencies do persist. One disadvantage of the telescoping hinge design is that it is not adaptable to the pivotable connection of large heavy structures. Another is the difficulty of aligning and inserting the smaller of the pivot tubes within the larger one, a problem whose magnitude increases exponentially as the length of the pivot axis increases—especially where lateral clearance and accessibility are limited. Even where lateral access does not impose a constraint, a structure to be pivotable secured relative to another may be so long that an individual installer may be unable to keep the two pivot tubes in alignment long enough to bring them into telescoping alignment. Finally, extrusion is a manufacturing technique well adapted to plastic materials or to softer, ductile metals and metal alloys (e.g., aluminum and brass), its application. However, the application of extrusion processes to materials having requiring greater load bearing ability, strength, wear resistance, and other mechanical properties—may require expensive post-extrusion processes such as annealing, quenching and the like.

Common to all of the aforementioned hinge structures are susceptibility to wear and corrosion, as well as a vulnerability to accidental separation where the objects attached to each hinge section are rotated together to some degree about an axis. Even a three-part hinge is vulnerable, in that the hinge pin can fall out when the entire hinge assembly is inverted (or subjected to centrifugal forces).

A need therefore exists for pinless hinge structures which can quickly self align, self-lock, and self-release, permitting a solo operator to easily actuate any locking mechanism located beyond his or her reach.

A further need exists for pinless hinge structures which can accommodate fail-safe locking structures which are not prone or susceptible to accidental release or separation once engaged.

Another need exists for pinless hinge structures which are impervious to malfunctions commonly caused by corrosion, dirt and debris.

Yet another need exists for pinless hinge structures which can be readily configured and adapted to pivotably couple a wide variety of objects and structures over a range of relative orientations and in a manner which permits the relative positions of these objects to be quickly and easily adjusted.

Still another need exists for an attachment assembly incorporating a pinless hinge structure wherein the hinge structure remains securely locked even when the entire assembly is rotated together to any degree and with respect to any axis of rotation, or when subjected to centrifugal force(s).

SUMMARY OF THE INVENTION

The aforementioned needs are addressed, and an advance is made in the art, by a pinless attachment assembly which comprises a pivot bar that defines at least one pair of recessed bearing surfaces with each pair of recessed bearing surfaces being separated by a transition zone. A major axis of all the transition zones lies in a first plane which bisects the respective bearing surfaces. A transverse pivot axis defined by the pivot bar lies within this first plane. A minor axis of the transition zone lies in a second plane orthogonal to the first plane. The minor axis of each transition zone corresponds to thickness dimension t which is substantially smaller than the spacing between the first and second bearing surfaces measured along the major axis.

The transition zone may have a constant thickness, or it may vary with respect to either axis. However, dimension t corresponds to a maximum thickness measured anywhere through the transition zone.

A pivot channel member is dimensioned and arranged for detachable pivotable coupling to the pivot bar. The pivot channel member defines a longitudinal axis and an interior pivot channel formed by a surface region having a substantially constant radius of curvature with respect to a reference line orthogonal to a third plane with which the longitudinal axis lies. The surface region of the interior pivot channel member defines a transversely extending gap having a width greater than t but substantially less than the minimum spacing between first and second bearing surfaces of the pivot bar (as measured along the major axis of the transition zone). Advantageously, this thin profile allows relatively heavy objects to be secured quickly and easily by a single installer, even without that installer being able to see the pivot bar and pivot channel members during installation.

Installation requires only a few simple steps. Relative linear translation between the pivot bar and pivot channel member in a direction parallel to the longitudinal axis of the pivot channel member brings a first recessed bearing surface into registration with the pivot channel surface region. This same relative translation brings the reference line into collinear relation with the pivot axis. Once in this position, the two components may be moved through a number of intermediate positions—any one of which may be suitable for a given application and poses no posing a risk of accidental separation. Any objects attached to the respective components are likewise movable into a desired angular juxtaposition. Once in a final position, the structure can be locked in place using any conventional approach, the installer having the peace of mind which comes from knowing that the two sections will remain in the selected orientation unless and until the gap is aligned with the transition zone to permit easy decoupling.

A variety of adaptations are possible. In some embodiments, multiple sets of structures are interconnected together to form independent structures such as hangars and the like. In other embodiments, multiple sets of structures are interconnected such that one attachment assembly maintain another (and any attached object) in a desired orientation. In some embodiments, the range of relative pivotable movement between the pivot bar and pivot channel member is increased by altering the contour of the pivot channel surface. In other embodiments, standoffs or attachment flanges are used to retain the pivot bar at a suitable spacing relative to a surface (e.g., greater than half the outside diameter of the pivot channel defined by the pivot channel member). This alternate arrangement provides the necessary clearance for linearly translating the pivot channel member relative to the pivot bar. In other embodiments, the object surface defines a cavity of sufficient dimensions to accommodate the requisite linear translation. In still other embodiments, the pivot bar functions alone to provide the requisite clearance without the need for standoffs, brackets or other hardware. By way of illustrative example, 90 degree bends e defined at each end of the pivot bar web provide the requisite clearance. Moreover, objects can be locked together when each has a pivot bar attached or each has a pivot channel member attached because two pivot bars can be locked to a common pivot channel or two pivot channel members can be locked to a common pivot bar.

In further embodiments, the pivot bar is a modular structure comprising a central web with slots dimensioned and arranged to allow one or more pairs of bearing surface modules to be slid onto the web and locked into place at any location. With this arrangement, the spacing between adjacent pairs of bearing surfaces can be adjusted to suit the needs of a given installation.

According to further embodiments, the pivot bar itself is dimensioned and arranged to provide necessary clearance for pivoting movement, obviating the need for standoffs, brackets or other hardware. By way of illustrative example, ninety degree bends can be formed at opposite ends of the pivot bar to define a pair of "ears" or protruberances for pivotably supporting the pivot bar—and any pivot channel member(s) pivotably coupled thereto—to another structure defining aligned apertures for receiving the ears.

The pivot bar and pivot channel member can be formed as independent structures dimensioned and arranged for attachment to external objects. Alternatively, they can be integrally formed as part of the objects themselves. Objects can be locked together when each has a pivot bar attached or each has a pivot channel member attached because two bars can be locked to a common channel or two channels can be locked to a common bar.

Additional features and advantages of the invention will be set forth in the detailed description which follows, and in part will be readily apparent to those skilled in the art from that description or recognized by practicing the invention as described herein, including the detailed description which follows, the claims, as well as the appended drawings. It is to be understood that both the foregoing general description and the following detailed description are merely exemplary of the invention, and are intended to provide an overview or framework for understanding the nature and character of the invention as it is claimed.

BRIEF DESCRIPTION OF THE DRAWINGS

The aspects of the present invention will become more apparent by describing in detail illustrative, non-limiting embodiments thereof with reference to the accompanying drawings, in which like reference numerals refer to like elements in the drawings.

DETAILED DESCRIPTION

Before describing the illustrated embodiment in detail by reference to particular contexts and applications, it should be borne in mind when reviewing the drawings and accompanying description that the inventive assemblies disclosed herein have a wide variety of applications. These applications include, among others: (a) the construction of a boat moorage system which obviates the need for ropes, cleats and fenders; (b) removable access doors and hatches for boats, recreational vehicles (RVs); homes and other buildings; (c) simple awning or signage kits, for installation on a home, rented apartment, commercial building, boat or RV, which can be installed by a single individual without regard to the spacing between points of attachments; (d) attachment of tables, chairs, beds, and other furnishings in boats, RVs, student dormitories, an the like where rapid installation, removal, and rearrangement to suit individual users' needs is highly desirable; (e) quick erection of security pens, animal pens, and chain link barricades which can be instantly disassembled and relocated; (f) solid panel room dividers ("Shoji" screen style) that can be instantly erected, moved or taken down for such uses as temporary office space dividers, exhibit dividers in trade show pavilions, auditorium stage dividers and background drops, etc; (g) locking garment hangers to hanger bars in clothing stores, dry cleaners, home closets, etc; (h) locking hangers for industrial applications and processes such, for example, as tank dipping, rapid connection of crane slings, loading ramps, scaffold and ladder attachments, etc, (i) rapid attachment of hurricane shutters, store and home window security panels, etc; (j) rapid deployment of canopies and shelters used at picnics, camping, street fairs, carnivals, military operations, disaster relief, and other outdoor events; (h) hitch arrangements for towing vehicles; (i) hinges for quickly and easily attaching objects (such as framed photos and picture) to walls or picture frame stands; and (j) educational construction sets similar in concept to Lego® and Erector Set® toys.

Prior art hinge structures have limited application to many if not most of the aforementioned situations wherein attached objects are rotated to some degree about some axis. This is due, in part, because the hinge members used therein are vulnerable to accidental separation. Even a three-part hinge is vulnerable as the hinge pin may fall out when inverted or subjected to centrifugal force. As will now be described in detail, embodiments of the present invention employ a pivot bar and pivot channel structure can be securely locked together to any degree and on any axis, even when subjected to centrifugal forces.

Figure 1:
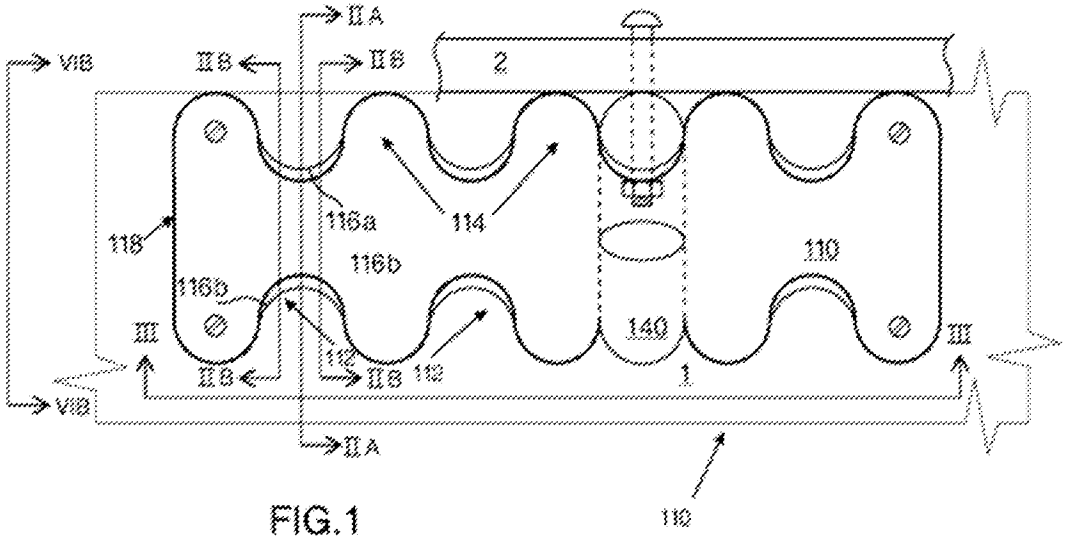
FIG. 1 is a front elevation view, in partial cross section, depicting the pivotable coupling of two objects using a pinless hinge structure constructed in accordance with an illustrative embodiment of the present invention.

With initial reference now to FIG. 1, there is shown an illustrative embodiment of a self-locking, self-aligning, and releasable assembly indicated generally at reference numeral 100. Assembly 100 includes a first member 110 and a second member 140. The first and second members 110 and 140 are dimensioned and arranged to accommodate pivotable movement relative to one another. First member 110 functions as a pivot bar while second member 140 functions as a pivot channel.

In some applications, one of the two members comprising assembly 100 may be affixed, attached, coupled, or otherwise secured to an external structure so that it can only be moved if and when that external structure itself is moved. For those scenarios, the other member may be pivotably coupled to the fixed member so as to permit movement about a pivot axis. Once a desired relative orientation is achieved, the first and second members can, if desired, be fixed relative to one another using any conventional means or structures. Alternatively, temporary supports may be used to hold the pivotably movable member at a desired position relative to the other, fixed member.

In other applications, it may be desirable to allow first and second members 110 and 140, and any objects to which they may be attached, to remain freely pivotable. In a picture frame set on a horizontal surface, for example, neither of members 110 and 140 (nor the objects to which they are attached) need be "fixed". A first member having the pivot bar defining characteristics of first member 110 may be secured to the back of a picture frame, while a second member having the pivot channel defining characteristics of second member 140 may be pivotably coupled according to the manner suggested by FIG. 1.

In the representative application shown in FIGS. 1 (and 7), however, first member 110 is being used to pivotably couple a first structure, indicated generally at reference numeral 1 and oriented in a substantially vertical plane, to a second structure indicated generally at reference numeral 2 and oriented in a substantially horizontal plane. As suggested by the preceding examples, however, any structures to which first and second members 110 and 140 may be attached can be manipulated into, and/or held in any desired orientation relative to a pivot axis, save for that singular orientation which allows the two members to be separated from one another. As will be described in greater detail shortly, the desired relative positions of the structures may be maintained briefly, or indefinitely, depending upon whether additional steps have been taken by the installer to lock one or both of the structures into a particular orientation.

Figure 3:
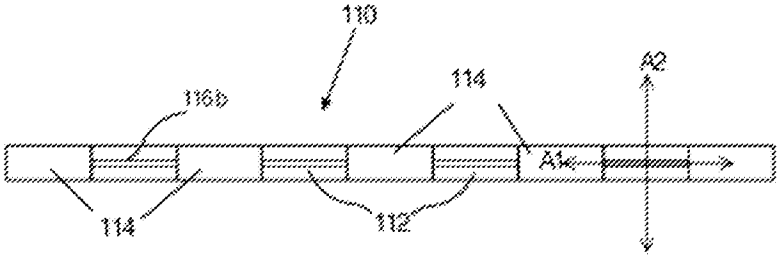
FIG. 3 is a bottom plan view taken across line III-III in FIG. 1, depicting an alternating arrangement of recessed bearing surfaces and projecting guide lobes defined by the exemplary first pinless hinge member of FIGS. 1 and 2.

In any event, and with continuing reference to the illustrative embodiment depicted in FIGS. 1-3, it will be seen that first member 110 is configured as an attachment pivot bar and includes a final set of opposed exterior surfaces which are collectively defined by an alternating network of opposed recesses, indicated generally at reference numeral 112, and lateral support guides, indicated generally at 114. Within each opposing pair of recesses 112 are corresponding bearing surfaces indicated generally at 116*a* and 116*b*. First member 110 also defines a pair of lateral edge surfaces as edge surface 118.

Figure 2A:
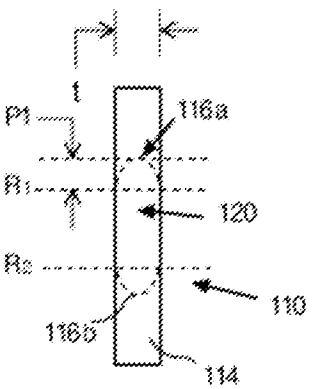
FIG. 2A is an elevation view taken in cross section across line IIA-IIA in FIG. 1, depicting the cross sectional profile of a pair of rounded bearing surfaces defined by a first member of a pinless hinge structure constructed in accordance with an illustrative embodiment of the present invention.
Figure 2B:
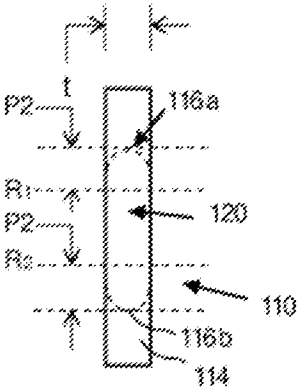
FIG. 2B is an elevation view taken in cross section at either of lines IIB-IIB in FIG. 1, illustrating the increase in the spacing of the rounded bearing surfaces, relative to a common reference plane, as the distance from the line IIA-IIA increases.

As will be described in greater detail later, bearing surfaces 116*a* and 116*b* (and adjacent surfaces within recess 114) are dimensioned and arranged to engage surfaces of the pivot channel defined by second member 114. FIGS. 2A and 2B shows that to minimize friction and wear between first member 110 and second member 140, bearing surfaces 116*a* and 116*b* may be provided with an arcuate cross sectional profile. Comparing FIGS. 2A and 2B, which are taken across reference planes IIA-IIA and IIB-IIB of FIG. 1, respectively, it can be seen that when measured from a common reference plane ($R_1$ or $R_2$), the peak of arcuate surfaces 116*a* and 116*b*, respectively, increases with distance away from the center of each recess 114. Thus, surfaces 116*a* and 116*b* have an arcuate profile which is shallower across reference plane IIA-IIA than across reference planes IIB-IIB. For example, height $P_1$ representing the peak of arcuate surfaces 116*a* (taken at IIA-IIA)—relative to common reference plane $R_1$—is less than $P_2$ representing the peak of arcuate surfaces 116*a* (taken at IIB-IIB) relative to that same reference plane. This arrangement provides a low friction interface between the first and second members to minimize wear.

Recesses 112 of first member 110 are separated by a web region indicated generally at reference numeral 120 (FIGS. 2A and 2B). As best seen in FIG. 3, a transverse pivot axis $A_1$ passes through the center of web region 120, intersecting with reference plane IIA-IIA (FIG. 1). One or both of first and second members 110 and 140 are pivotable about axis $A_1$ to reach the relative positions shown in FIG. 1.

Figure 7:
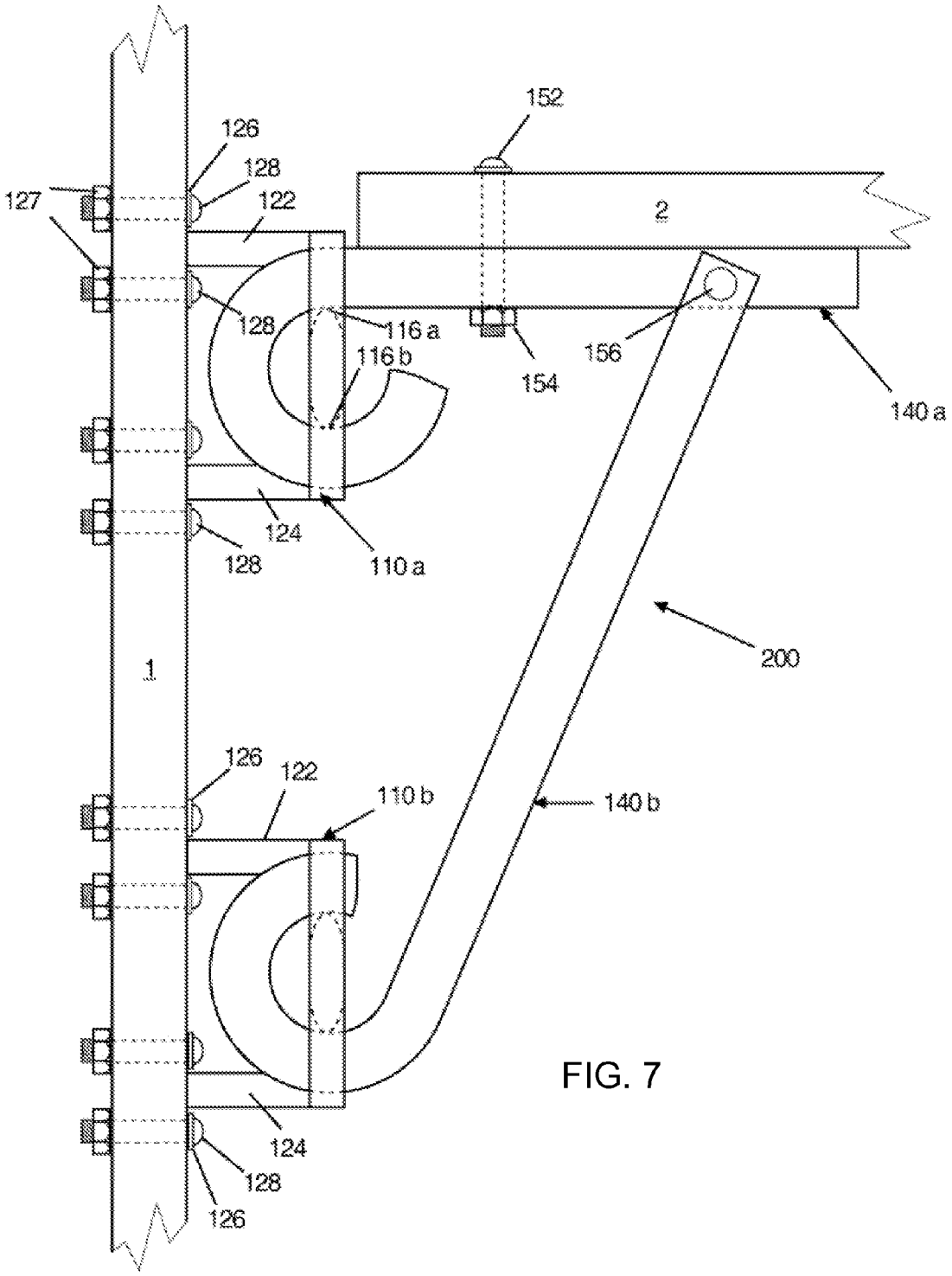
FIG. 7 depicts a representative application of several pinless hinge assemblies according to an embodiment of the invention, wherein a pair of structures may be locked in a fixed relation but from which they may be easily detached.

With momentary reference to FIG. 7, it will be seen that first member 110 is supported at a distance D from the exterior surface of first structure 1. In the illustrative embodiment of FIGS. 1-3 and 7, this is achieved by a pair of supports 122 and 124, each of which has an apertured flange (not shown) designed for fastening as by temporary means such as mechanical fasteners or by permanent attachment means such, for example, as welding or integral forming during the manufacturing process) directly to a load bearing structural component of structure 1. It suffices to say that the precise manner in which first member is attached to a structure such as structure 1 admits of substantial variation. The specific approach adopted will depend upon the physical and other characteristics of the structure itself, those of the load being attached, and whether or not future disassembly is desirable or contemplated.

If a blind attachment penetrating into a hollow cavity is required, for example, a cantilever fastener such as the one disclosed by U.S. Pat. No. 5,944,466 issued to Rudnicki et al on Aug. 31, 1999 and entitled Cantilever Fastener Assembly may be utilized. By way of alternate example, it is possible to fabricate unitary objects and structures in which one or more pivot bars and pivot channels, respectively, are integrally formed thereon during the manufacturing process as by conventional casting, injection molding, and/or machining techniques.

Figure 4A:
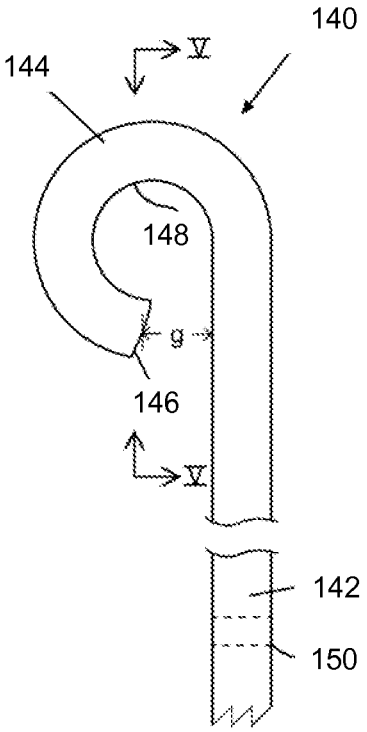
FIG. 4A is a side elevation view of a second member of the illustrative pinless hinge structure shown in FIG. 1.

Turning now to FIG. 4A, it will be seen that second member 140 comprises a shank portion 142 extending from its proximal end, a tip 146 at its distal end, and an intermediate section 144 which extends therebetween. Intermediate section 144 defines an arcuate surface 148 which, in some embodiments, has a curvature compatible with a bearing, low-friction fit with surfaces 116*a* and 116*b* of first section 110 (FIG. 1). It is arcuate surface 148 which forms the outer boundary of a pivot channel and, to this end, it is dimensioned and arranged to engage a respective pair of bearing surfaces 116*a* and 116*b* when positioned as shown in FIG. 1. An optional, transverse bore 150 permits attachment of second member 140 to an external structure, such as structure 2 of FIG. 1. As noted earlier, it is contemplated by the inventor herein that any suitable means may be employed to fix second member 140 to an object—such, for example, as adhesive, straps and ties, welding, threaded fasteners, and in fact the member itself may actually be formed as part of such object by casting, molding or machining processes as also noted previously.

It should be noted that although a geometry consistent with a continuous, low friction bearing relationship between pivot bar recessed surfaces 116*a* and 116*b* and surface 148 is shown and described, herein, other arrangements are possible and deemed by the inventor herein to be within the scope of the invention. For example, the respective surfaces may be defined with very loose tolerances and there is no requirement that their respective profiles and any radii of curvature match precisely so long as the capacity for relative, pivotable movement over a range meaningful to a given application is obtained. Thus, for example, the first member or pivot bar may be constructed as plain, die stamped structure with flat rather than curved bearing surfaces in each respective pair of recesses.

Moreover, at least the proximal portion of shank 142 may be defined with internal threads or with external threads or cerrations so as to accommodate linear extension as by a telescoping attachment or the like. In this manner, a pivot channel defining member as second member 140 can be obtained that is extendable at any desired angle relative to the pivot bar defining first member (and any structure attached thereto).

It should be emphasized that there is no requirement that the portion of second member 140 which defines the pivot channel extend rectilinearly from shank 142. That is, according to a modified embodiment of the invention (not shown), shank 142 may be configured with two discrete regions—a first or proximal region defining a first longitudinal axis and a second or distal region defining a second longitudinal axis. According to some embodiments, the first shank region extends from the second shank region at an angle less than 180 degrees. According to these some embodiments of the invention, the pivot channel extends from, is formed as part of, or is otherwise defined by a first of the discrete shank regions (e.g., the distal shank region), and is thus the pivot channel is maintained at a predetermined angle relative to the second of the discrete shank regions.

Along the same lines, the respective bearing surfaces may constructed with square, oval, v-shaped or other mating profiles in the bearing surfaces of the first and second members, respectively.

Figure 4B:
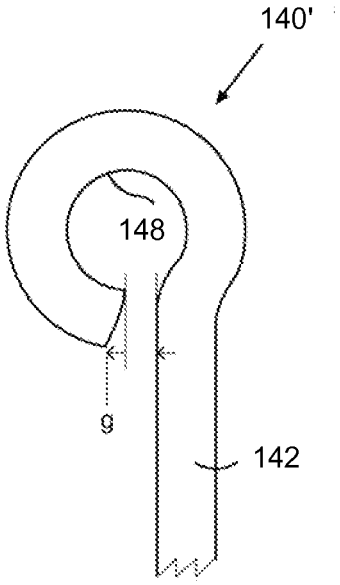
FIG. 4B is a side elevation view of an alternate second member of a pinless hinge structure, constructed in accordance with a modified embodiment of the present invention.
Figure 5:
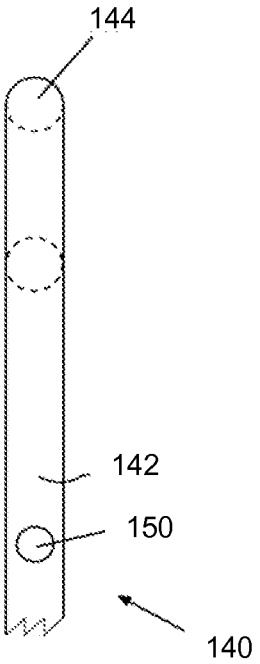
FIG. 5 is a front elevation view, taken in cross section across line V-V in FIG. 4, of the exemplary second member of FIG. 4A.

FIG. 4B depicts a modified embodiment of a second member 140' which is also dimensioned and arranged for compatibility with first member 110 (FIG. 1). This modified version provides an arcuate bearing channel surface 148 which has a more close fitting relationship to surfaces 116*a* and 116*b* of first member 110. This closer fitting relationship extends the range of relative, lockable, and pivotable movement between members 110 and 140. As best shown in FIG. 5, second member 140 can be advantageously (but need not be) formed from round bar stock, with the required curvature being formed by suitable metal working operations. Of course, if a different means of forming second member 140 is used, then complementary adaptations will be required to the pivot bar bearing and support surfaces as surfaces 116*a* and 116*b* of first member 110.

With particular reference to FIGS. 4A and 4B, it will be noted that two separate dimensions are noted. Dimension d represents the overall maximum depth dimension of intermediate portion 144 of second member 140. Dimension g represents the gap or clearance between tip 146 and the portion of intermediate portion 144 which meets shank 142.

Figure 6A:
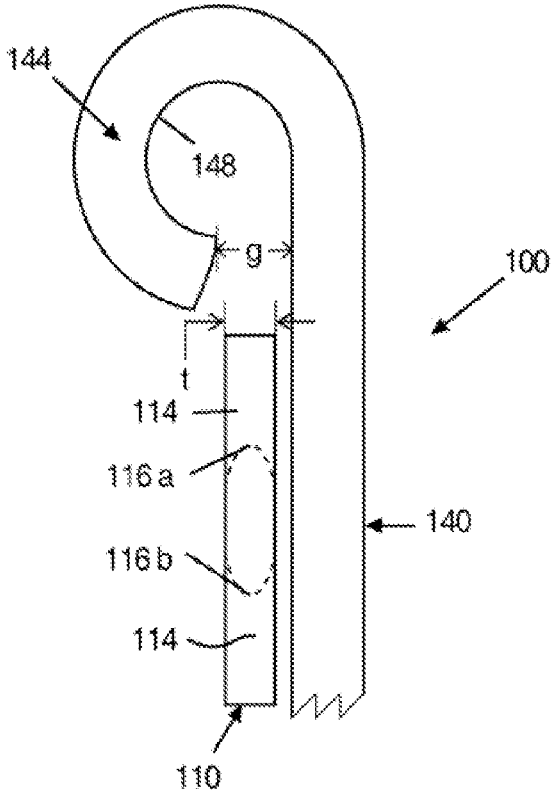
FIGS. 6A-6D depict a progressive sequence of positions of the second member of FIG. 4A relative to the first member, as may be effected to pivotably couple a first structure secured to the first member to a second structure secured to the second member and arrive at their relative orientations shown in FIGS. 1 and 7.
Figure 6B:
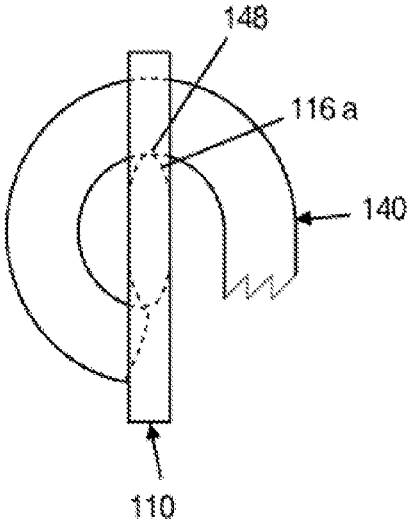
Figure 6C:
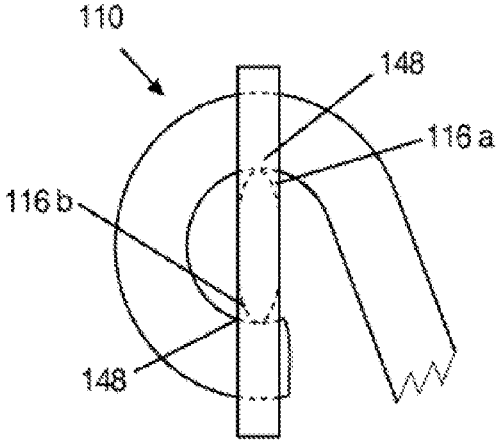

Turning now to FIGS. 6A-6B the process of pivotably coupling first and second members of assembly 100 according to the principles of the present invention will now be described in detail. Firstly, first and second members are aligned in the manner shown in FIG. 6A. Dimension g between tip 146 (FIG. 4A) and shank 142 (FIG. 4A) is sufficiently larger than dimension t such that members 110 and 140 can be moved relative to one another from the position shown in FIG. 6A to the position shown in FIG. 6B. The latter orientation shows pivot bar bearing surfaces as surface 116*a* of first member 110 in contact with pivot channel surface 148 of second member 140. From this initial position of alignment—which can be easily achieved on a "blind" basis wherein a single installer cannot even see the mating structures—the second member is rotated about pivot axis $A_1$ through the position shown in FIG. 6C. In some applications, the relative positions of first member 110 and second member 140 shown in FIG. 6C might be suitable as a "final" position. For example, if first member 110 were attached to the back of a picture frame by a suitable standoff structure (not shown) giving a clearance greater than d, then the relative positions shown for members 110 and 140 would be suitable for supporting the picture frame at a desired table-top orientation.

Figure 6D:
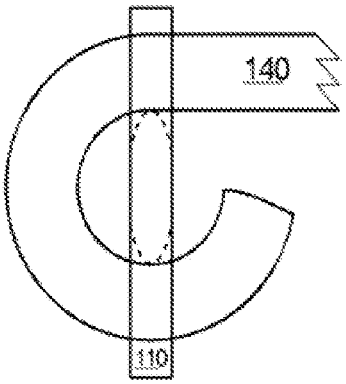

For attachment of two objects as structures 1 and 2 lying in perpendicular planes according to FIG. 1, one or both of the members 110 and 140 are rotated to reach the position shown in FIG. 6D. Due to the flattening of shank portion 142, further pivoting movement of the members 110 and 140 could cause wear or damage to the bearing surfaces 116*a*, 116*b* and 148. If further range of movement is desired, a configuration of second member such as the one illustrated in FIG. 4B may be used.

Turning once more to FIG. 7, there is shown a representative application of several pinless hinge assemblies according to an embodiment of the invention, wherein a pair of structures are locked in a fixed relation but from which they may be easily detached. In this case, structure 1 is oriented in a first plane and has attached to it by a pair of pivot bar defining first members indicated generally at reference numerals 110*a* and 110*b*. Each of these pivot bar members as member 110*a* is supported above the surface of structure 1 by a distance D. The dimension of distance D is such that it exceeds d (FIG. 4A or 4B) by a sufficient margin as to allow the necessary clearance for pivotable movement of the pivot channel defining members 140*a* and 140*b* according to FIGS. 6A-6D. In the exemplary embodiment of FIG. 7, apertured flanges 122 and 124 extend from the back surface of pivot bar members 110*a* and 110*b* and are secured to the first structure by washers 126, bolts 128 and nuts 127.

Where no access is available to the back of structure 1, then penetration into load bearing channels or studs may be relied upon for the requisite attachment. Alternatively, the aforementioned cantilever fasteners disclosed by Rudnicki et al in U.S. Pat. No. 5,944,466 may be used. It suffices to say that any conventional method of attachment may be used subject to the constraints imposed by the loads involved, the operating environment and costs for labor and materials.

In any event, and with continued reference to FIG. 7, it will be seen that a second structure 2 is attached to first pivot channel member 140*a*. As already described in connection FIG. 1, this attachment can be implemented by any conventional technique. In the illustrative example of FIG. 7, this is achieved by one or more through bolts. For cosmetic purposes, it may be preferable to utilize concealed fasteners or hangers viewable only from the underside. By way of further illustrative example, first member 110*a* may be welded to the underside of structure 2 or even designed to screw into a tapped bore defined in the structure 2.

Once the first channel member 140*a* that is attached to, formed on or otherwise secured to structure 2 has been installed and pivoted into the position shown in FIG. 7 (following the sequence depicted in FIGS. 6A-6D), it may be desirable to retain the first and second structures 1 and 2 in this particular orientation. As has already been mentioned in the description of FIGS. 1-3, such an orientation can be maintained by using one or more supports. In the embodiment of FIG. 7, a second pivot channel member 140*b* is provided to support structure 2 in a second plane that is fixed relative to the first plane. To this end, second pivot channel member 140*b* is first installed onto second pivot bar member 110*b* according to the initial, intermediate and final positions exemplified in FIGS. 6A-6C, respectively (though inverted). At this point, pin 156 is inserted into an aperture at the shank end of pivot bar member 140*b*. This aperture aligns with a corresponding aperture in pivot bar member 140*a*, such that insertion of pin 156 ties the two together and prevents relative movement thereof.

Figure 8:
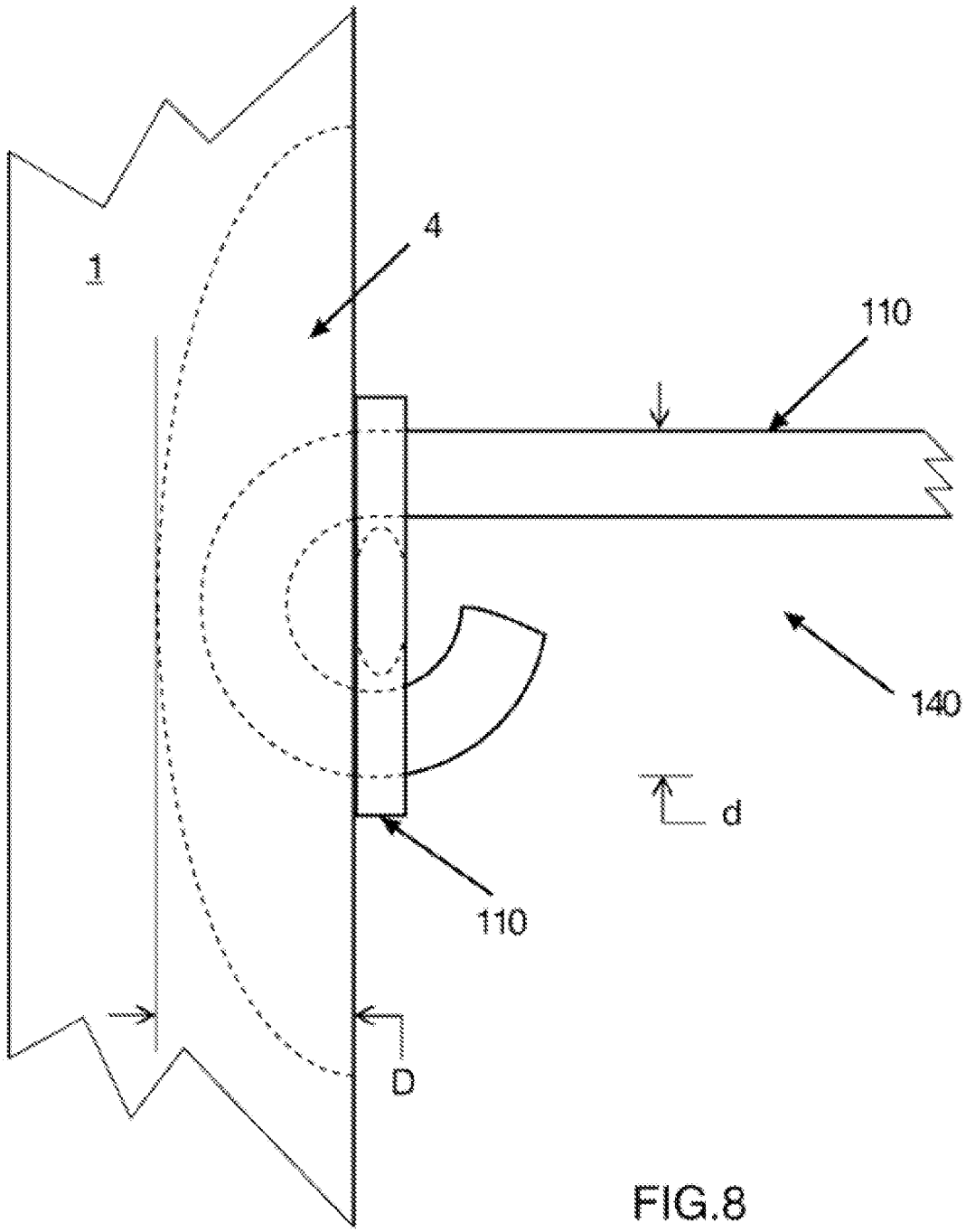
FIG. 8 depicts a further embodiment and application of a pinless hinge assembly constructed in accordance with the present invention and utilizing the modified second member configuration shown in FIG. 4B, wherein the first member is bonded to a first structure or object and at least one pair of bearing surfaces of the first member are aligned with a cavity in the first structure.

Usage of the embodiment of FIG. 4B is shown in FIG. 8, wherein the clearance D is provided not by a standoff or flange as was the case for FIG. 7, but rather by placing first member 110 such that the corresponding recess(es) 112 (FIG. 1) are aligned with a cavity 4 defined in the surface of structure 1. Pivotable coupling of a first member 110 to a second member 140 proceeds in the same manner as described in connection with FIGS. 6A-6D, and in FIGS. 1 and 7.

Figure 9:
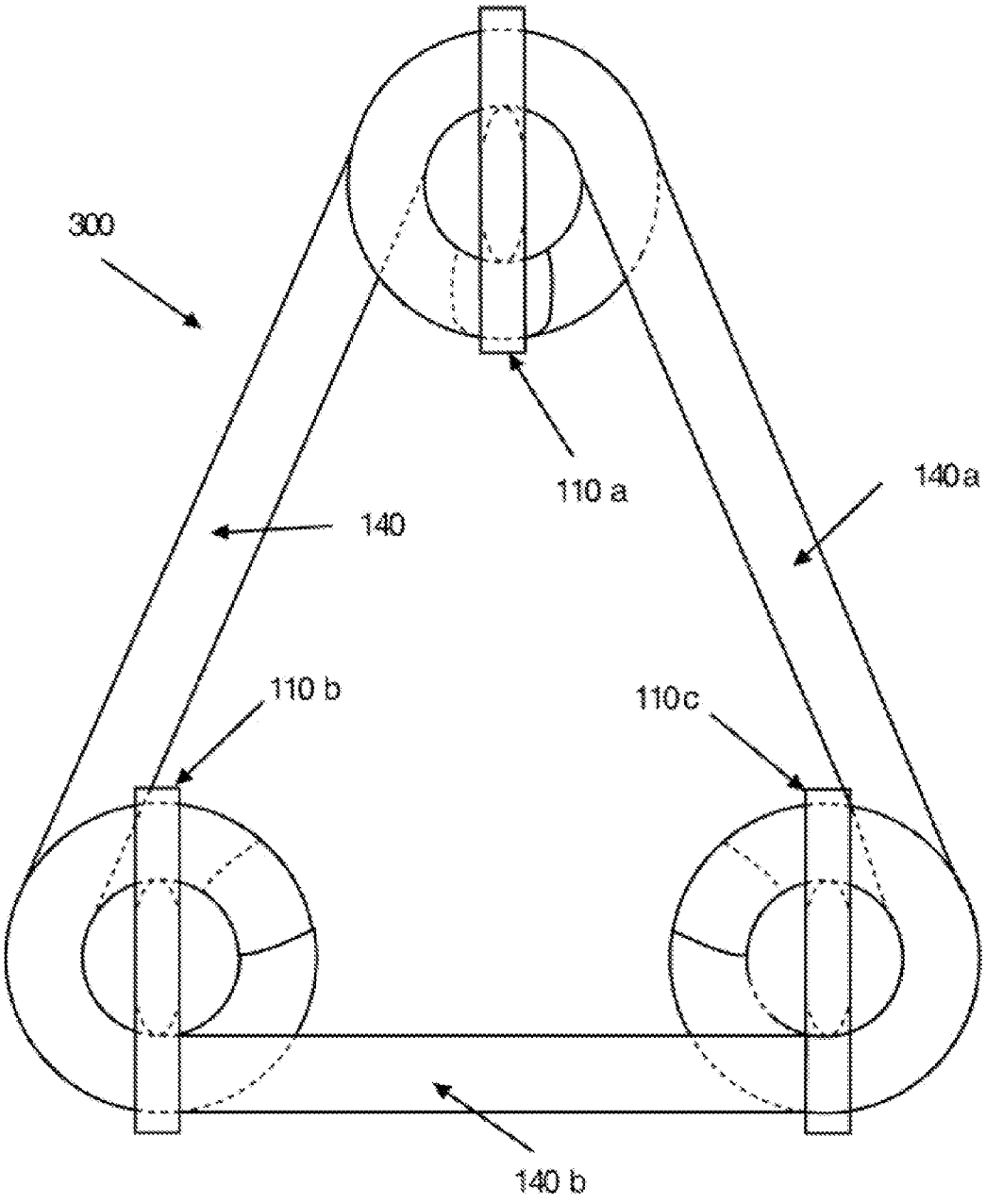
FIG. 9 depicts yet another embodiment and application of pinless hinge assemblies constructed in accordance with the present invention, wherein the respective sets of first and second members comprising each respective hinge assembly are coupled to one another to form independent structures of adaptable utility.

FIG. 9 depicts yet another embodiment and application of pinless hinge assemblies constructed in accordance with the present invention, wherein respective sets of first members as members 110*a*, 110*b* and 110*c* are oriented in parallel planes. They are juxtaposed relative to one another so that their recesses 112 (FIG. 1) are aligned, allowing corresponding second members 140, 140*a* and 140*b* to interlock in the manner shown. The shank end of each second members as member 140 may be held in place within a recess by a retainer (not shown) bonded, attached or otherwise secured to the corresponding first member as first member 110*a*.

Figure 10A:
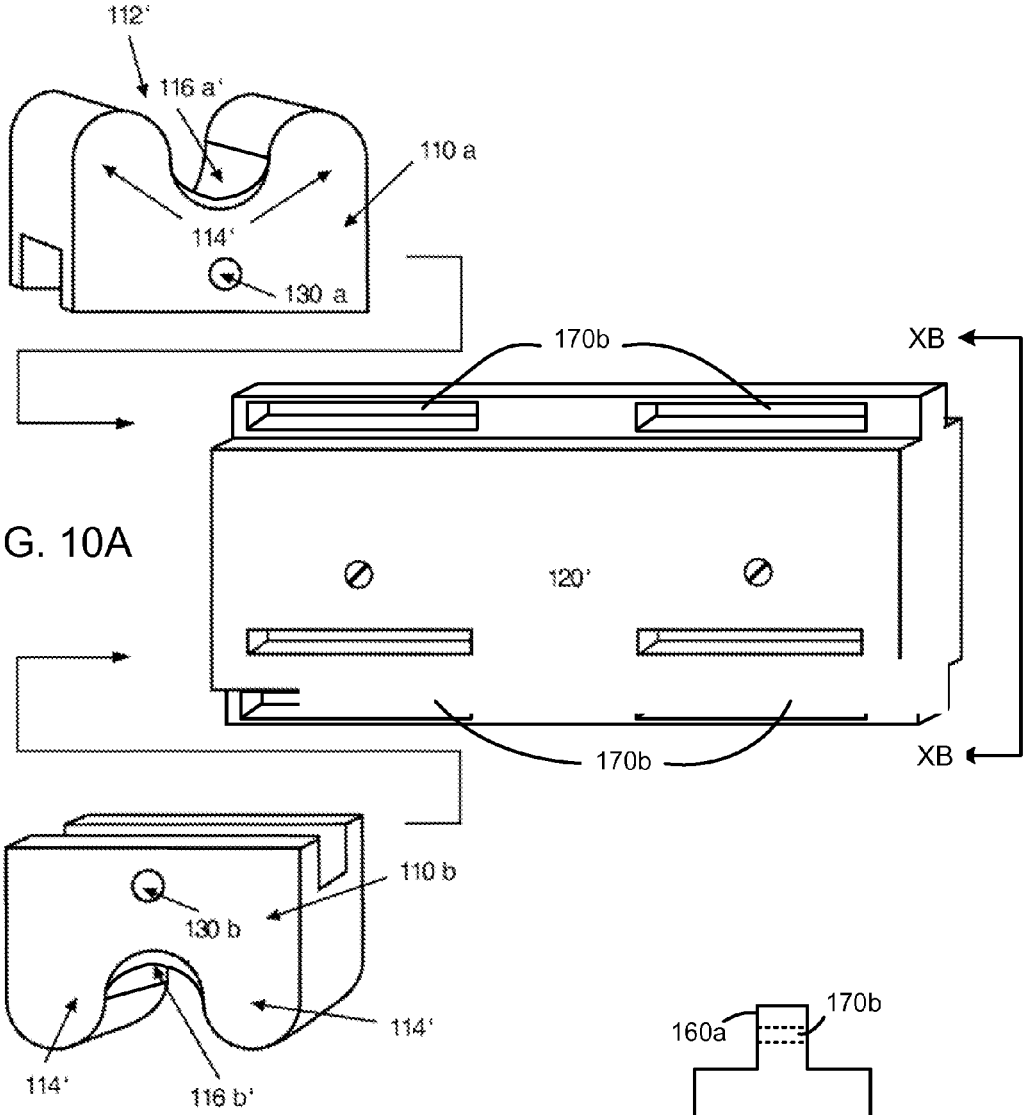
FIG. 10A is a perspective view in front elevation, depicting a modified embodiment wherein the relative positions of the bearing surfaces of the first member may be adjusted relative to one another and to a structure to which the first member is attached to accommodate even greater flexibility and utility.
Figure 10B:
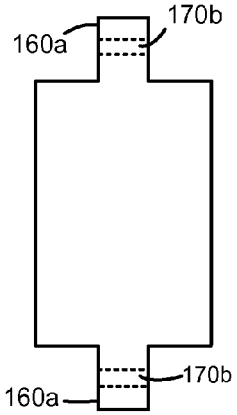
FIG. 10B is a side elevation view of the modified embodiment of FIG. 10A.

FIG. 10A is a perspective view in front elevation, depicting a modified embodiment wherein the relative positions of the bearing surfaces of the first member may be adjusted relative to one another and to a structure to which the first member is attached to accommodate even greater flexibility and utility. To this end, in place of a unitary first member 110 exemplified by FIG. 1, a modular structure is provided in which the pivot bar bearing surfaces, indicated generally at 116*a*' and 116*b*', are defined within corresponding recesses, indicated generally at 112' and formed between guides 114' of movable structures 110*a* and 110*b* respectively. Structures may be added or removed as needed depending upon the needs of the installation. As seen in FIGS. 10A and 10B, slots 170*b* defined in the reduced thickness sections 160*a* of web region defining member 120', allow each movable pivot bar member as members 110*a* and 110*b* to bring respective apertures, as apertures 130*a* and 130*b*, into a desired locking location. Rear slots formed in member 120' further accommodate the desired alignment and adjustment.

Figure 11A:
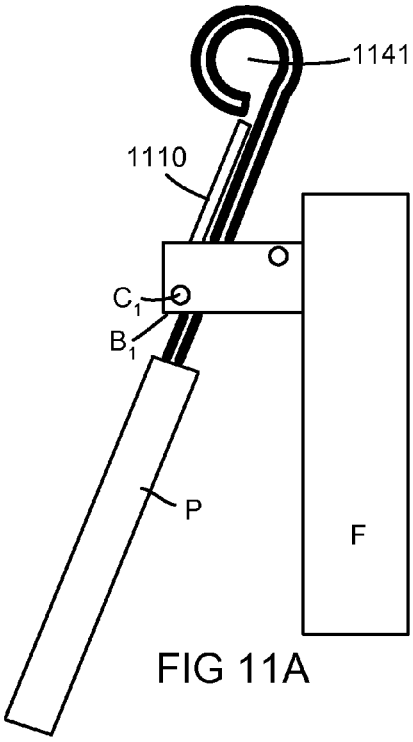
FIG. 11A depicts, in side elevation, yet another embodiment utilizing a modified pivot bar constructed accordance with the teachings of the present invention.
Figure 11B:
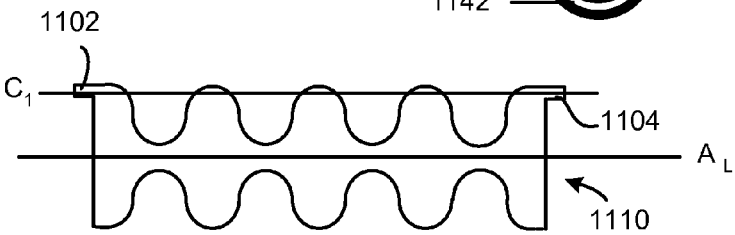
FIG. 11B is a front elevation view of the modified pivot bar utilized in the embodiment depicted in FIG. 11A.

Turning to FIGS. 11A and 11B and 12, there is shown a modified attachment assembly in accordance with an alternative embodiment of the present invention. The embodiment of FIGS. 11A and 11B illustrate a further characterizing feature of the invention—its ability to accommodate not just pivotable movement between two structures but also precise lateral adjustment of their relative positions.

Beginning with FIG. 11A, there is shown a window frame F from which a pair of retaining brackets—only one of which, indicated generally $B_1$ is shown) project (at a location above an opening (not shown) in window frame F. The pair of brackets as bracket $B_1$ each define an aperture, the apertures being aligned with one another to accommodate the insertion of modified pivot bar 1110. Pivot bar 1110 may, in all material respects, be identical to the fixed mounted structure 110 shown in FIG. 1. In this case, however, pivot bar 1110 is simply a die stamped structure with flat (non-arcuate) recess surfaces 1116 (FIG. 11B). Moreover, unlike previously described embodiments, pivot bar 1110 is configured to be, itself, pivotable relative to the structure to which it is attached (e.g., window frame F)—at least during the installation and removal processes.

To this end, and as best seen in FIG. 11B, at least one protuberance or "ear", indicated generally at 1102 and 1104, extends respectively from a corresponding end of pivot bar 1110. These protuberances are aligned with one another along an axis of rotation $C_1$ and they are dimensioned and arranged for insertion into a corresponding pair of apertures in aligned brackets as bracket $B_1$. In the embodiment of FIGS. 11A and 11B, the axis of rotation $C_1$ is offset from a longitudinal axis $A_L$ of pivot bar 1110. The extent of this offset is determined by the placement of protuberances 1102 and 1104.

To storm window or panel P of FIG. 11A, there is attached a pivot channel member 1140 which is in all material respects identical to the pivot channel member 140 shown and described in FIG. 4A or pivot channel member 140' shown in FIG. 4B. Owing to its modified construction, pivot bar member 1102 is pivotably movable relative to both brackets B1 and B2 (and the frame with which it is associated) and also with respect to the pivot channel member 1140. Pivot channel member 1140 is moved upward to pivot the "free" (i.e. unsecured) end of pivot bar 1110 up so that the former can be slid down over/onto the pivot bar 1110. Once pivot bar 1110 is free to pivot inside the channel 1141 defined by pivot channel member 1140, rotation of pivot bar 1110 about axis $C_1$ proceeds so as to bring panel P closer to the window opening within frame F. A simple shuttle pin (located at position "x" in FIG. 11A) locks the pivot channel member 1140 (using an extension rod if it is out of reach) in place over the opening defined in frame F. In a storm panel application, a number of such locking positions may be included from which an operator can select to obtain a desired amount of spacing between the panel and an overlying window opening and, thereby, a user-selectable amount of ventilation.

Figure 12A:
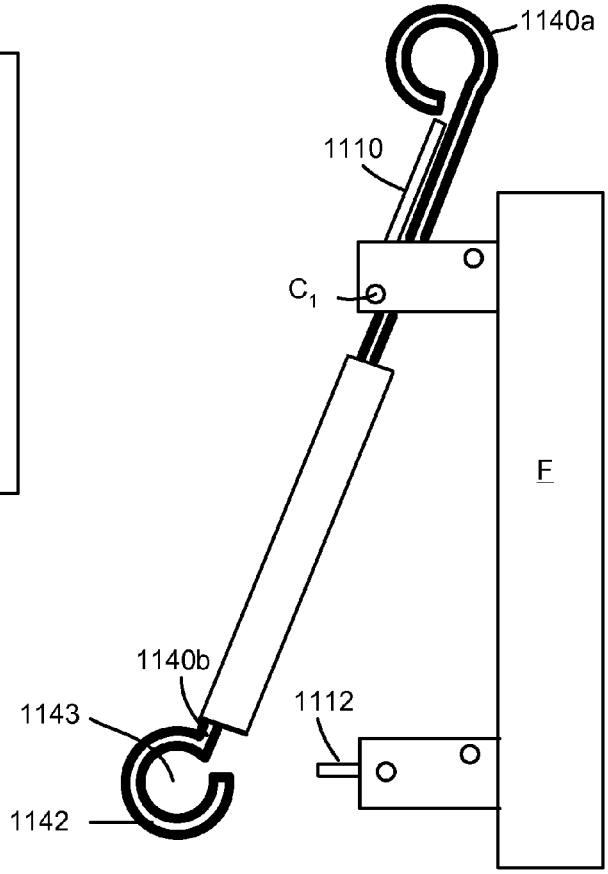
FIG. 12A depicts a further embodiment utilizing the modified pivot bar shown in FIG. 11B as well as another alternative pivot bar configuration and correspondingly modified pivot channel constructed in accordance with the teachings of the present invention.
Figure 12B:
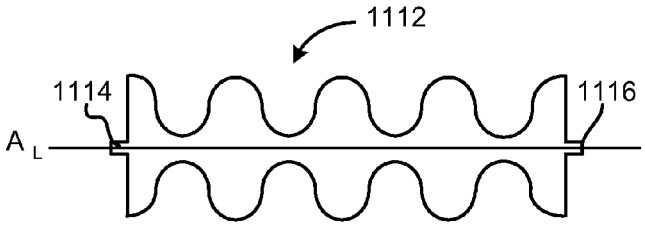
FIG. 12B is a front elevation view of alternative pivot bar configuration depicted in FIG. 12A.

The embodiment of FIG. 11A is, of course, adaptable to still further customization, modification and adaptation for ease of use and to acquire additional functionality. One example of further adaptation is shown in FIGS. 12A and 12B, which is optionally configured for mounting an awning AW and also storing the awning in a secure configuration when not in use. In the illustrative embodiment of FIG. 12A, wherein like reference numerals in common with FIG. 11A are used to identify like elements, an additional pivotably mounted pivot bar 1112 is shown. As best seen in FIG. 12B, modified pivot bar 1112 lacks an offset between the pivot axis defined by protuberances 1114 and 1116 and centerline/longitudinal axis $A_L$. That is, the two axes are one and the same.

A further difference visible from comparison of FIGS. 11A and 12A is that in the latter, either a second pivot channel member, coupled to awning AW, is provided to define an angularly offset channel portion associated with modified pivot bar 1112 or each end of a single pivot channel member is modified so as to define a respective pivot channel 1141 and 1143 at a corresponding end thereof. In the instant case, two pivot channel members indicated generally at numerals 1140*a* and 1140*b* are used. By using two separate pivot channel members as members 1140*a* and 1140*b*, manipulation into the respective orientations of use suggested by 140*a* and 140*b* in FIG. 7 are readily obtained. As seen in FIG. 12A, the gap associated within channel 1143 is oriented differently than the gap associated with channel 1141. For further adjustment, either or both of pivot channel members 1140*a* and 1140*b* are realized as sets of telescoping structures with corresponding threads or cerrations to accommodate variable extension if and when desired. For locking in a stowed position, the lower pivot channel slides over pivot bar 1112 and the latter pivots into a locking position maintained, as before, by inserting a pin at location X shown in FIG. 12A.

It is believed that other modifications, variations and changes will be suggested to those skilled in the art in view of the teachings set forth herein. By way of illustrative example only, a pivot bar constructed in accordance with other embodiments of the present invention is formed by die stamping. Some of these die-stamped embodiments have flat recessed bearing surfaces as opposed to the complex arcuate recessed bearing surfaces described elsewhere in this specification and depicted in the corresponding drawings. Thus, the bearing surfaces may, in cross section, have a flat or curvilinear contour as may be realized, for example, using a square profile, an elliptical or ellipsoidal profile, a v-shaped profile, or any other desired simple or complex bearing surface profile.

As a further example, the pivot channel defining portion of the second member need not extend rectilinearly (i.e., in the same direction) from the shank portion. According to some embodiments, the pivot channel defining portion extends at an obtuse angle, and in others, as shown in FIG. 12B, it may extend at a 90 degree angle. Unlike the prior art, pivot bar and pivot channel configurations described and illustrated herein can be readily adapted, adjusted and modified to address a wide variety of applications and for ease of use.

It is therefore to be understood that all such variations, modifications and changes are believed to fall within the scope of the present invention. Although specific terms are employed herein, they are used in their ordinary and accustomed manner only, unless expressly defined differently herein, and not for purposes of limitation.

What is claimed is:

1. An attachment assembly for detachably coupling a first object to a second object, comprising:

a first structure dimensioned and arranged for attachment to the first object and having a pair of opposed peripheral surfaces separated by a web region, a first peripheral surface of the pair defining a first recess, a second peripheral surface of the pair defining a second recess aligned with the first recess, wherein the first and second recesses collectively define a first pivot bar bearing surface, and a transverse pivot axis passing through the web region at a midpoint between the pair of opposed peripheral surfaces; and a second structure dimensioned and arranged for attachment to the second object and defining an interior pivot channel at a distal end thereof, the second structure including a proximal shank region, a distal tip, and an intermediate region interconnecting said shank region and said distal tip;

wherein the distal tip is separated from the shank portion by a gap of sufficient width as to allow the web region of the first structure to pass through the gap as a surface of the interior pivot channel is brought into bearing registration with the first pivot bar bearing surface; and wherein the interior pivot channel is dimensioned and arranged to receive the portion of the web region separating the first and second recesses and to frictionally engage at least a portion of the first pivot bar bearing surface while the second structure is pivoted relative to the first structure about the transverse pivot axis.

2. The assembly of claim 1, wherein the interior pivot channel surface is an arcuate surface defined by the intermediate region, the arcuate surface having a radius of curvature measurable relative to the transverse pivot axis.

3. The attachment assembly of claim 1, wherein the first structure defines third and fourth recesses defining a second pivot bar bearing surface, the transverse pivot axis passing through the web region at a point midway between the third and fourth recesses.

4. The attachment assembly of claim 3, wherein the shank and intermediate region each have a substantially circular cross-sectional profile.

5. The attachment assembly of claim 4, wherein each of the first, second, third and fourth recesses have a rounded, arcuate profile defining a radial curvature corresponding to the substantially circular cross-sectional profile of the second member.

6. The attachment assembly of claim 1, wherein the first structure is attached to the first object.

7. The attachment assembly of claim 6, wherein the second structure is attached to the second object.

8. The hinge assembly of claim 7, further including a third structure dimensioned and arranged for attachment to the first object and having a second pair of opposed peripheral surfaces separated by a second web region, a first peripheral surface of the second pair defining a third recess, a second peripheral surface of the second pair defining a fourth recess aligned with the third recess, wherein the third and fourth recesses collectively define a second pivot bar bearing surface, and a second transverse pivot axis passing through the second web region at a midpoint between the second pair of opposed peripheral surfaces; and a fourth structure defining a second interior pivot channel at a distal end thereof, the fourth structure including a second proximal shank region, a second distal tip, and an intermediate region interconnecting said second shank region and said second distal tip;

wherein the distal tip of the fourth structure is separated from the second proximal shank portion of the fourth structure by a gap of sufficient width as to allow the second web region of the third structure to pass through the gap as a surface of the second interior pivot channel is brought into bearing registration with the second pivot bar bearing surface; and wherein a proximal end portion of the second structure and a proximal end of the fourth structure defines an axially alignable bore dimensioned and arranged to receive a removable pin.

9. The attachment assembly of claim 1, wherein the second structure is attached to the second object.

10. The attachment assembly of claim 1, wherein the shank and intermediate portion of the second member has a substantially circular cross-sectional profile and wherein the first and second recesses have a rounded, arcuate profile defining a radial curvature corresponding to the substantially cross sectional profile of the second member.

11. The attachment assembly of claim 1, wherein the web region of the first member has a substantially constant thickness.

12. An attachment assembly, comprising:

a pivot bar defining first and second recessed bearing surfaces separated by a transition zone, a major axis of the transition zone lying in a first plane bisecting the first and second recessed bearing surfaces, a pivot axis defined by the pivot bar lying within the first plane, and a minor axis of the transition zone lying in a second plane orthogonal to the first plane, the minor axis having a dimension t substantially smaller than a spacing between the first and second bearing surfaces measured along the major axis; and a pivot channel member dimensioned and arranged for detachably pivotable coupling to the pivot bar, the pivot channel member defining a longitudinal axis and an interior pivot channel formed by a surface region having a substantially constant radius of curvature with respect to a reference line orthogonal to a third plane within which the longitudinal axis lies, wherein opposed surface regions of the pivot channel member further define a transversely extending gap having a width greater than t but less than a spacing between the first and second bearing surfaces of the pivot bar measured along the major axis of the transition zone, whereby relative linear translation between the pivot bar and pivot channel member in a direction parallel to the longitudinal axis of the pivot channel member brings the first recessed bearing surface into registration with the pivot channel surface region and brings the reference line into collinear relation with the pivot axis, and whereby bearing registration persists between at least the first recessed bearing surface and the pivot channel surface region upon relative pivotable movement therebetween.

13. The attachment assembly of claim 12, wherein the pivot bar further defines third and fourth recessed bearing surfaces separated by a second transition zone, a major axis of the second transition zone lying in the first plane, and wherein a minor axis of the second transition zone lies in the second plane.

14. The attachment assembly of claim 13, wherein the pivot bar further defines fifth and sixth recessed bearing surfaces separated by a third transition zone, a major axis of the third transition zone lying in the first plane, and wherein a minor axis of the third transition zone lies in the second plane.

15. The attachment assembly of claim 12, wherein the pivot channel member is dimensioned and arranged for attachment to an object and including a proximal shank region, the longitudinal axis passing through the length of the proximal shank region, a distal tip for defining the interior pivot channel, and an intermediate region interconnecting said shank region and said distal tip;

wherein the distal tip is separated from the shank portion by gap t so as to allow the transition region of the pivot bar to pass through the gap as a surface of the interior pivot channel is brought into bearing registration with recessed bearing surface;

wherein the interior pivot channel surface is an arcuate surface defined by the intermediate region; and wherein the interior pivot channel is dimensioned and arranged to receive the portion of the transition region separating the recesses and frictionally engage at least a portion of the first recessed bearing surface while the pivot channel member and pivot bar are pivoted relative to one another about the pivot axis.

16. The attachment assembly of claim 12, wherein the pivot channel member is integrally formed as part of a larger structure selected from the group consisting of removable access doors, removable hatches, awnings, signage, and shutters.

17. The attachment assembly of claim 12, wherein the pivot bar is integrally formed as part of a larger structure to which an object is pivotably connected using at least one pivot channel member.

18. A method of releasably attaching first and second structures, comprising:

providing a pivot bar defining a pair of recessed bearing surfaces separated by a transition zone, a major axis of the transition zone lying in a first plane bisecting the pair of recessed bearing surfaces, a pivot axis defined by the pivot bar lying within the first plane, and a minor axis of the transition zone lying in a second plane orthogonal to the first plane, the minor axis having a dimension t substantially smaller than a spacing between the first and second bearing surfaces measured along the major axis;

providing a pivot channel member dimensioned and arranged for detachably pivotable coupling to the pivot bar, the pivot channel member defining a longitudinal axis and an interior pivot channel formed by a surface region having a substantially constant radius of curvature with respect to a reference line orthogonal to a third plane within which the longitudinal axis lies, wherein the surface region of the interior pivot channel member defines a transversely extending gap having a width greater than t but less than a spacing between first and second bearing surfaces of the pivot bar measured along the major axis of the transition zone;

linearly translating the pivot bar relative to the pivot channel in a direction parallel to the longitudinal axis of the pivot channel member so as to bring at least one recessed bearing surface into registration with the pivot channel surface region and the reference line into collinear relation with the pivot axis;

rotating the pivot bar and pivot channel member relative to one another into a final position in which the gap is no longer aligned with the transition zone, and maintaining the relative positions of the pivot bar and pivot channel member following the rotating step, whereby beating registration persists between at least the first recessed bearing surface and the pivot channel surface region during such pivotable relative movement and thereafter and whereby unintentional linear translation of the pivot bar relative to the pivot channel is prevented.

19. The method of claim 18, further including a step of securing at least one of the pivot bar and the pivot channel member to an external structure.

20. The method of claim 18, further including steps of providing a second pivot bar defining a second pair of recessed bearing surfaces separated by a transition zone, a major axis of the second transition zone lying in a fourth plane bisecting the second pair of recessed bearing surfaces, a second pivot axis defined by the second pivot bar lying within the fourth plane, and a minor axis of the second transition zone lying in a fifth plane orthogonal to the fourth plane;

providing a second pivot channel member dimensioned and arranged for detachably pivotable coupling to the second pivot bar, the second pivot channel member defining a second longitudinal axis and a second interior pivot channel formed by a second surface region having a substantially constant radius of curvature with respect to a reference line orthogonal to a sixth plane within which the second longitudinal axis lies, wherein the second surface region defines a transversely extending gap having a width greater than t but less than a spacing between the second pair of bearing surfaces; and linearly translating and rotating the second pivot channel and second pivot bar member relative to one another, wherein the maintaining step includes securing a proximal end of the second pivot channel member to a proximal end of the first pivot channel member.

* * * * *